US007002051B2

(12) United States Patent
Bonelli et al.

(10) Patent No.: US 7,002,051 B2
(45) **Date of Patent: *Feb. 21, 2006**

(54) PHOTOBLEACH SPECKLE AND LAUNDRY DETERGENT COMPOSITIONS CONTAINING IT

(75) Inventors: Juan Jose Bonelli, Buenos Aires (AR); Marcio Henrique Perissinotto Bonfa, Sao Paulo (BR); Rudolf Govert Van Driel, Sao Paulo (BR); Paulo-Enrique De Gusmao, Sao Paulo (BR); Mario Jovelino Del Nunzio, Sao Paulo (BR); Paulo Cesar Puelle Andrade, Sao Paulo (BR)

(73) Assignee: Unilever Home and Personal Care USA Division of Conopco, Inc., Greenwich, CT (US)

( * ) Notice: Subject to any disclaimer, the term of this patent is extended or adjusted under 35 U.S.C. 154(b) by 694 days.

This patent is subject to a terminal disclaimer.

(21) Appl. No.: 10/223,566

(22) Filed: Aug. 19, 2002

(65) Prior Publication Data

US 2003/0087791 A1 May 8, 2003

(30) Foreign Application Priority Data

Aug. 20, 2001 (GB) ..... 0120160

(51) Int. Cl.
*C11D 3/00* (2006.01)
*C11D 17/00* (2006.01)

(52) U.S. Cl. ..... 570/301; 510/349; 510/441

(58) Field of Classification Search ..... 510/301, 510/349, 441, 443
See application file for complete search history.

(56) References Cited

U.S. PATENT DOCUMENTS

| | | | | |
|---|---|---|---|---|
| 2,889,283 A * | 6/1959 | Tecklenburg | ..... | 510/441 |
| 3,931,037 A | 1/1976 | Hall | ..... | 252/135 |
| 4,721,633 A | 1/1988 | Baldassin | ..... | 427/212 |
| 4,762,636 A | 8/1988 | Balliello et al. | ..... | 252/95 |
| 5,605,883 A | 2/1997 | Iliff et al. | ..... | 510/444 |
| 6,696,400 B1 * | 2/2004 | Puelle Andrade et al. | .. | 510/301 |

FOREIGN PATENT DOCUMENTS

| | | |
|---|---|---|
| DE | 3430773 | 3/1985 |
| EP | 057 088 | 8/1982 |
| EP | 119 746 | 9/1984 |
| EP | 737 739 | 10/1996 |
| GB | 2 199 338 | 7/1988 |
| WO | 98/16615 | 4/1998 |
| WO | 99/51714 | 10/1999 |
| WO | 01/77274 | 10/2001 |
| WO | 02/10327 | 2/2002 |

* cited by examiner

*Primary Examiner*—Mark Kopec
*Assistant Examiner*—John M Petruncio
(74) *Attorney, Agent, or Firm*—Rimma Mitelman

(57) ABSTRACT

A colored speckle composition for use in particulate laundry detergent compositions comprising a porous granular carrier and at least 0.01 wt % photobleach, preferably at least 0.05 wt %, more preferably at least 0.1 wt %, based on the active ingredient, the composition having an average bulk density of at most 600 g/l, preferably at most 500 g/l, most preferably at most 400 g/l. The carrier system reduces the staining tendency of the photobleach. The most preferred carrier is spray dried detergent base powder. The most preferred photobleach is a blend of Zn and Al sulphonated phthalocyanine.

21 Claims, No Drawings

PHOTOBLEACH SPECKLE AND LAUNDRY DETERGENT COMPOSITIONS CONTAINING IT

TECHNICAL FIELD

The present invention relates to a coloured granular composition for use as speckles in a particulate laundry detergent composition comprising photobleach.

BACKGROUND AND PRIOR ART

Photobleaches are often added to detergent laundry powders to provide bleaching of the washed fabrics to improve their visual appeal. The most common and simplest way of incorporating them into detergent powders is to add them to the slurry prior to spray drying of the base powder. However some of the photobleach may be lost due to degradation and evaporation in the spray drying process. Furthermore, there is a well-known problem of staining of the washed fabric due to the photobleach.

EP 119 746A (Unilever) discloses spraying a solution or suspension of a Zn or Al phthalocyanine sulphonate photobleach onto a detergent base powder subsequent to the spray drying process.

WO 99 51714A (Unilever) discloses a coloured photobleach speckle composition giving reduced staining wherein the carrier is an α-hydroxy organic acid, preferably citric acid, with a water-soluble barrier material and a flow aid e.g. silica. The composition is claimed to provide reduced fabric staining.

DE 3 430 773A (Ciba Geigy) discloses a washing powder additive in speckle form which contains a photobleach, an inorganic carbonate and an acid. Effervescence action generated by the reaction between the carbonate and the acid is claimed to keep the speckles at the surface of the wash liquor and reduce staining of the washed fabrics.

U.S. Pat. No. 3,931,037 (Procter & Gamble) discloses a colourless granular composition comprising a pale-coloured photobleach granule made by the dry-mixing of a phthalocyanine photobleach particle and a granular material (e.g. sodium tripolyphosphate or spray-dried detergent base powder) to which a liquid (e.g. water) is added.

U.S. Pat. No. 4,762,636 (Ciba-Geigy) discloses a process for the preparation of spray-dried floating speckles that contain an active substance.

SUMMARY OF INVENTION

The present inventors have surprisingly found that a coloured speckle composition comprising photobleach which is carried on a spray-dried detergent base powder is able to float on the surface of the wash liquor due to its natural density and provides an attractively coloured speckle which contrasts with the colour of the majority of the detergent powder and delivers a photobleach to the fabric with little or no staining.

In a first aspect, the present invention provides a coloured granular composition for use as speckles in a particulate laundry detergent composition comprising a porous granular carrier, which is a spray-dried detergent base powder comprising surfactant and optionally builder, and at least 0.01 wt % photobleach based on the active ingredient, the composition having an average bulk density of at most 600 g/l.

In a second aspect, the present invention provides a particulate laundry detergent composition which comprises surfactant, optionally builder, and from 0.05 to 10 wt % of speckles which are a coloured granular composition as defined above.

In a third aspect, the present invention provides a process for making a coloured granular composition for use as speckles in a particulate laundry detergent composition, which comprises the steps of:

(i) mixing an aqueous solution of photobleach with a porous carrier having an average bulk density of no more than 600 g/l; followed by (ii) layering with a finely divided, high liquid carrying capacity particulate material.

In a fourth aspect, the present invention provides the use of a spray-dried detergent base powder carrying a liquid photobleach as speckles in a particulate laundry detergent composition.

DETAILED DESCRIPTION

The Speckles

The coloured granular compositions of the present invention are intended to be used as speckles in particulate laundry detergent compositions. It is important that such speckles comprise at least 0.01 wt % of the photobleach active ingredient and that in order to float readily on the surface of the water they should have an average bulk density of at most 600 g/l. Preferably the average bulk density is at most 500 g/l and more preferably at most 400 g/l.

As well as providing reduced staining photobleach delivery, the speckles are intended to provide an attractive colouration to the powder which the consumer sees during use. Hence it is preferred that the speckles have a number average particle size of at least 200 microns, preferably at least 400 microns.

In order that the speckles may provide effective delivery of photobleach for the whole of the detergent powder for which they are intended to be incorporated it is preferred that they comprise at least 0.05 wt % photobleach based on the active ingredient, preferably at least 0.1 wt %.

The carrier for the speckles is a spray-dried detergent base powder comprising surfactant and optionally builder.

Commercially available photobleaches often come as an aqueous solution and, to improve the process of adding the photobleach to the carrier, other liquid materials may also be added. An especially useful ingredient is propylene glycol.

Preferred photobleaches are phthalocyanine sulphonates, especially zinc phthalocyanine sulphonates, aluminium phthalocyanine sulphonates or a mixture of the two.

Since the speckle composition floats on the surface of the water due to its natural buoyancy, it is unnecessary to include ingredients which may cause effervescence, and hence it is preferred that the speckle is non-effervescent. However, inclusion of effervescence-generating ingredients is within the scope of the invention.

The Process for Making the Speckles

The process of manufacture of the speckles according to the present invention involves the steps of:

(i) mixing a liquid photobleach with a porous carrier having an average bulk density of no more than 600 g/l; followed by (ii) layering with a finely divided, high liquid carrying capacity particulate material.

Preferably the carrier material has an average bulk density of at most 500 g/l, more preferably at most 400 g/l.

In order to improve the process it is preferred that the process is preceded by the step of blending an aqueous solution of photobleach with propylene glycol.

Preferred high liquid carrying capacity particulate materials are zeolite and/or silica.

A particularly advantageous process is wherein step (i) comprises atomising and spraying the liquid photobleach onto the porous carrier.

The carrier for the speckles may be any material so as to give a speckle with an average bulk density of at most 600 g/l and is compatible with particulate laundry detergent compositions. A preferred material is one that has been spray-dried. Especially preferred is a spray-dried detergent base powder comprising surfactant and optionally builder. An alternative material is granular light sodium carbonate (light soda ash).

The Particulate Laundry Detergent Composition

Detergent compositions of the present invention comprise surfactant and optionally builder. They also contain from 0.05 to 10 wt %, preferably from 1 to 5 wt %, of speckles as described above. It is preferred that the compositions comprise from 5 to 60 wt % surfactant and from 10 to 80 wt % builder.

It is preferred that the particulate detergent compositions comprise a spray-dried base powder, and more preferably wherein the composition of the carrier of the speckles is substantially the same as the composition of the base powder. This combination enables the carrier for the speckles to be taken from the stock of base powder of the detergent composition and thus enabling manufacturing simplicity.

In a particularly advantageous embodiment the whole composition is coloured blue, however the speckles contained within it are a darker shade of blue than the rest of the composition. In another particularly advantageous embodiment the bulk of the powder is coloured white and the speckles are coloured blue.

To ensure that the speckles do not segregate out from the rest of the composition it is preferred that the average bulk density of the speckles is within 100 g/l, preferably within 50 g/l, of that of the composition as a whole. Additionally it is preferred that the number average particle size of the speckles is within 200 microns, preferably within 100 microns, of that of the composition as a whole.

Photobleach may be present in both the speckles and the composition as a whole, and preferably at least 50 wt % of the total photobleach present is within the speckles. It is most preferred that the photobleach is entirely contained within the coloured speckles.

Detergent Ingredients

The particulate laundry detergent compositions of the present invention will also contain conventional detergent ingredients, notably detergent-active materials (surfactants), and preferably also detergency builders.

Such detergent compositions will contain one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds. Non-soap anionic surfactants are especially preferred.

Non-soap anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates.

Sodium salts are generally preferred. A preferred anionic surfactant is linear alkylbenzene sulphonate.

Nonionic surfactants may optionally be present. These include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants may optionally be present. These include quaternary ammonium salts of the general formula $R_1R_2R_3R_4N^+ X^-$ wherein the R groups are long or short hydrocarbyl chains, typically alkyl, hydroxyalkyl or ethoxylated alkyl groups, and X is a solubilising anion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

In an especially preferred cationic surfactant of the general formula $R_1R_2R_3R_4N^+ X^-$, $R_1$ represents a $C_8$–$C_{10}$ or $C_{12}$–$C_{14}$ alkyl group, $R_2$ and $R_3$ represent methyl groups, $R_4$ presents a hydroxyethyl group, and $X^-$ represents a halide or methosulphate ion.

Optionally, amphoteric surfactants, for example, amine oxides, and zwitterionic surfactants, for example, betaines, may also be present.

Preferably, the quantity of anionic surfactant is in the range of from 5 to 50% by weight of the total composition. More preferably, the quantity of anionic surfactant is in the range of from 8 to 35 wt %, most preferably from 10 to 30 wt %.

Nonionic surfactant, if present, is preferably used in an amount within the range of from 1 to 20 wt % in addition to that which may be present in the structured emulsion.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Crosfield Chemicals Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00.The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Most preferably, the builder is selected from sodium tripolyphosphate, zeolite, sodium carbonate, and combinations thereof.

Organic builders may optionally be present. These include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxy-methyloxymalonates, dipicolinates, hydroxyethyl iminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system, although non-bleaching formulations are also within the scope of the invention.

The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA) and the polyphosphonates such as Dequest (Trade Mark), EDTMP.

The detergent compositions may also contain one or more enzymes. Suitable enzymes include the proteases, amylases, cellulases, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as Carezyme (Trade Mark) ex Novo.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example, cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22.

Especially preferred soil release polymers are the sulphonated non-end-capped polyesters as described and claimed in WO 95 32997A (Rhodia Chimie).

The detergent compositions may also include one or more inorganic salts other than builder salts. These may include, for example, sodium bicarbonate, sodium silicate, sodium sulphate, magnesium sulphate, calcium sulphate, calcium chloride and sodium chloride. Preferred inorganic salts are sodium sulphate, sodium chloride, and combinations thereof.

The detergent compositions may also contain other inorganic materials, for example, calcite, silica or amorphous aluminosilicate, or clays.

Other ingredients that may be present include solvents, hydrotropes, fluorescers, dyes, foam boosters or foam controllers (antifoams) as appropriate, fabric conditioning compounds and perfumes.

Preparation of the Detergent Composition

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes. In both types of powder, the speckle composition may be incorporated by postdosing (dry mixing).

The composition of the invention may alternatively be in tablet form. Tablets may be prepared by compacting powders, especially "concentrated" or "compact" powders, prepared as described above. Additionally, the composition may be in the form of a liquid, gel, paste or extrudate.

EXAMPLES

Examples 1 and 2

Photobleach Speckles

Speckle compositions were prepared to the following formulation:

TABLE 1

| Ingredient | wt % of base powder | wt % of total |
|---|---|---|
| Spray Dried Base | | |
| Sodium LAS | 25.75 | 22.6 |
| Sodium silicate | 11.40 | 10.0 |
| Sodium tripolyphosphate | 17.21 | 15.1 |
| Sodium carboxymethylcellulose | 0.72 | 0.63 |
| Sodium sulphate | 35.33 | 31.0 |
| Fluorescer | 0.25 | 0.22 |
| Blue colourant | 0.021 | 0.018 |
| Water | 9.32 | 8.18 |
| Sub Total | 100.0 | 87.75 |
| Post-Dosed | | |
| Zeolite | | 2.5 |
| Silica | | 2.5 |
| Propylene glycol | | 6.0 |
| Photobleach (as 10% active) | | 1.25 |
| Total | | 100.0 |

In Example 1, the photobleach used was a mixture of zinc and aluminium phthalocyanine sulphonate.

In Example 2, the photobleach used was an aluminium phthalocyanine sulphonate.

Both photobleaches were obtained from Ciba-Geigy under the "Tinolux" Trade Mark.

It will be seen that both compositions contained 0.125 wt % photobleach calculated as 100% active.

Each composition was prepared as follows.

The ingredients except the zeolite, silica, propylene glycol and photobleach were sequentially added to water to form a slurry, which was subsequently spray-dried to form a base-powder with an average bulk density of about 450 g/l and a number average particle size of 648 microns. Meanwhile the liquid propylene glycol was blended with a 10% active solution of the photobleach.

The liquid blend was then sprayed onto the spray-dried base-powder and gently mechanically agitated to ensure good mixing. Finally the zeolite and the silica were added as layering agents and gentle mechanical agitation was resumed to ensure good coverage of the granules. The resultant speckle composition had a bulk density of around 500 g/l, a number average particle size of 709 microns and had an intense blue colouration.

Example 3 and 4 and Comparative Examples A to D

Photobleach Staining

The spray-dried detergent compositions tested for staining had the following formulation:

TABLE 2

| Ingredient | wt % of base powder | wt % of total |
|---|---|---|
| Spray Dried Base | | |
| NaLAS | 25.74 | 18.13 |
| Sodium silicate | 11.40 | 8.03 |
| Sodium tripolyphosphate | 17.21 | 12.12 |
| Sodium carboxymethylcellulose | 0.72 | 0.51 |
| Sodium sulphate | 35.32 | 24.88 |
| Fluorescer | 0.25 | 0.18 |
| Antifoam granule | 0.027 | 0.019 |
| Blue colourant | 0.021 | 0.015 |
| Water | 9.31 | 6.56 |
| Sub Total | 100.0 | 70.44 |
| Post-Dosed | | |
| Sodium sulphate | | 9.57 |
| Sodium carbonate | | 15.0 |
| Dequest 2047 (sequestrant) | | 0.40 |
| Enzymes | | 0.24 |
| Sodium perborate | | 3.35 |
| TAED | | 1.0 |
| Total | | 100.0 |

Photobleach speckles were added to this detergent base to make compositions either inside or outside the present invention.

Example 3 contained 2 wt % of a speckle composition according to Example 1 where the photobleach was a mixture of zinc and aluminium phthalocyanine sulphonate.

Example 4 contained 2 wt % of a speckle composition according to Example 1 where the photobleach was aluminium phthalocyanine sulphonate.

Comparative Example A contained 2 wt % of an aluminium phthalocyanine sulphonate photobleach speckle of the same concentration as in Example 1 but with dense soda ash as a carrier.

Comparative Example B contained 2 wt % of an aluminium phthalocyanine sulphonate photobleach speckle of the same concentration as in Example 1 but with clay as a carrier.

Comparative Example C contained 2 wt % of a mixture of zinc and aluminium phthalocyanine sulphonate photobleach speckle of the same concentration as in Example 1 but with clay as a carrier.

Comparative Example D contained no photobleach speckle.

Experimental Protocol

Six pieces of white knitted cotton of size 15 cm×15 cm were used as test cloths. The cloths were placed at the bottom of a bowl containing 1 litre of water, onto which 10 g of the detergent composition was poured. The detergent composition was allowed to settle for 10 minutes, after which the fabric was removed and gently rinsed to remove any detergent residues. The fabrics were subsequently dried in a tumble drier and then assessed for the degree of staining, by an expert panel, on a scale of 1 to 5. A result of 1 means no staining and a result of 5 means full staining. A summary of the experimental conditions and the staining results are shown in table 3.

TABLE 3

| Experiment | Photobleach | Carrier | Bulk Density g/l | Degree of staining |
|---|---|---|---|---|
| 3 | Zn/Al | As in Example 1 | 505 | 1–2 |
| 4 | Al | As in Example 2 | 431 | 1–2 |
| A | Al | Dense soda ash | 1100 | 3 |
| B | Al | Clay | 935 | 5 |
| C | Zn/Al | Clay | 935 | 4 |
| D | — | — | — | 1 |

Examples 5 to 8

Detergent Compositions

The formulations shown in Table 4 represent detergent compositions in accordance with the invention.

TABLE 4

| | wt % | | | |
|---|---|---|---|---|
| Ingredient | 5 | 6 | 7 | 8 |
| Spray Dried Base | | | | |
| Sodium LAS | 17.73 | 6.59 | 19.5 | 12.3 |
| Nonionic surfactant($C_{12-13}$ 6–7 EO) | — | 3.27 | — | 2.9 |
| Sodium soap | 0.78 | 2.39 | — | — |
| Sodium tripolyphosphate | 21.4 | 24.1 | 31.7 | 34.4 |
| Sodium silicate | 7.34 | 6.79 | 5.63 | 6.58 |
| Sodium carboxymethylcellulose | 0.33 | 0.49 | 0.20 | 0.47 |
| Fluorescer | 0.10 | 0.13 | 0.11 | 0.14 |
| Sodium sulphate | 22.6 | 25.8 | 12.3 | 0.61 |
| Sodium chloride | — | — | — | 1.83 |
| Silicone antifoam | — | — | 0.03 | 0.05 |
| Water | 12.8 | 9.8 | 12.1 | 16.0 |
| Post Dosed | | | | |
| Sodium carbonate | 14.2 | 16.7 | 12.7 | 15.33 |
| Enzymes | 0.45 | 0.58 | 0.24 | 0.68 |
| Perfume | 0.28 | 0.33 | 0.27 | 0.31 |
| Antifoam granule | — | 1.0 | — | 3.0 |
| Sodium perborate | — | — | 2.38 | 2.5 |
| TAED | — | — | 0.86 | 0.90 |
| Photobleach speckles of Example 1 | 2.00 | 2.00 | 2.00 | 2.00 |

We claim:

1. A coloured granular speckle composition for use in a particulate laundry detergent composition comprising a porous granular carrier, which is a spray-dried detergent base powder comprising surfactant and optionally builder, and at least 0.01 wt % photobleach active ingredient, the composition speckle layered with a finely divided, high liquid carrying capacity particulate zeolite and/or silica, and the composition having an average bulk density of at most 600 g/l.

2. A coloured granular composition according to claim 1, which has an average bulk density of at most 500 g/l.

3. A coloured granular composition according to claim 2, which has an average bulk density of at most 400 g/l.

4. A coloured granular composition according to claim 1, which has a number average particle size of at least 200 microns.

5. A coloured granular composition according to claim 4, which has a number average particle size of at least 400 microns.

6. A coloured granular composition according to claim 1, which comprises at least 0.05 wt % photobleach based on the active ingredient.

7. A coloured granular composition according to claim 6, which comprises at least 0.1 wt % photobleach.

8. A coloured granular composition according to claim 1, which also comprises propylene glycol.

9. A coloured granular composition according to claim 1, wherein the photobleach is a zinc and/or aluminium phthalocyanine sulphonate.

10. A coloured granular composition according to claim 9, wherein the photobleach is a mixture of zinc and aluminium phthalocyanine sulphonate.

11. A coloured granular composition according to claim 1, which is non-effervescent.

12. A particulate laundry detergent composition which comprises surfactant, optionally builder, and from 0.05 to 10 wt % of speckles which are a coloured granular composition according to claim 1.

13. A detergent composition according to claim 12, which comprises a spray-dried base powder and wherein the composition of the carrier of the speckles is substantially the same as the composition of the base powder.

14. A detergent composition according to claim 12, which comprises from 1 to 5 wt % of speckles.

15. A detergent composition according to claim 12, which comprises from 5 to 60 wt % surfactant and from 10 to 80 wt % builder.

16. A detergent composition according to claim 12, wherein the bulk of the composition is blue and the speckles are a darker shade of blue than the rest of the composition.

17. A detergent composition according to claim 12, wherein the bulk of the composition is white and the speckles are blue.

18. A detergent composition according to claim 12, wherein the average bulk density of the speckles is within 100 g/l, of that of the composition as a whole.

19. A detergent composition according to claim 12, wherein the number average particle size of the speckles is within 200 microns, of that of the composition as a whole.

20. A detergent composition according to claim 12, wherein at least 50 wt % of photobleach present in the composition is contained within the coloured speckles.

21. A detergent composition according to claim 20, wherein all photobleach in the composition is contained within the coloured speckles.

* * * * *